United States Patent [19]

Oda et al.

[11] Patent Number: 4,843,424

[45] Date of Patent: Jun. 27, 1989

[54] REVERSE DEVELOPING IMAGE FORMING APPARATUS WITH DISTURBING MEANS

[75] Inventors: Goro Oda, Sagamihara; Haruhiko Ishida, Tokyo, both of Japan

[73] Assignee: Tokyo Shibaura Denki Kabushiki Kaisha, Kawasaki, Japan

[21] Appl. No.: 139,837

[22] Filed: Dec. 29, 1987

Related U.S. Application Data

[60] Division of Ser. No. 907,312, Nov. 19, 1986, Continuation of Ser. No. 571,800, Jan. 8, 1984, Pat. No. 4,727,395.

[30] Foreign Application Priority Data

Jan. 20, 1983 [JP] Japan ..... 58-7726
Feb. 28, 1983 [JP] Japan ..... 58-32429

[51] Int. Cl.[4] ..... G03G 15/08

[52] U.S. Cl. ..... 355/268; 355/269; 118/652

[58] Field of Search ..... 355/3 DD, 14 D, 15, 355/3 R; 118/652, 657, 658; 430/100

[56] References Cited

U.S. PATENT DOCUMENTS

| | | | |
|---|---|---|---|
| 3,117,884 | 1/1964 | Greig | 117/17.5 |
| 3,649,262 | 3/1972 | Cade et al. | 355/15 X |
| 3,997,262 | 12/1976 | Doi et al. | 355/11 |
| 4,230,406 | 10/1980 | Klett | 355/15 |
| 4,320,958 | 3/1982 | Fantuzzo | 355/3 DD |
| 4,384,545 | 5/1983 | Burnham et al. | 118/651 |
| 4,426,151 | 1/1984 | Aguro et al. | 355/15 |
| 4,470,693 | 9/1984 | Dolan | 355/15 |
| 4,500,198 | 2/1985 | Daniels | 355/14 D |
| 4,505,573 | 3/1985 | Brewington et al. | 355/3 DD |
| 4,727,395 | 2/1988 | Oda et al. | 355/3 DD |

FOREIGN PATENT DOCUMENTS

| | | |
|---|---|---|
| 3006033 | 8/1980 | Fed. Rep. of Germany . |
| 3140190 | 5/1982 | Fed. Rep. of Germany . |

*Primary Examiner*—R. L. Moses
*Attorney, Agent, or Firm*—Cushman, Darby & Cushman

[57] ABSTRACT

In an image forming apparatus according to the present invention, a cleaning device which allows for the repeated use of the photosensitive drum is removed from a space between a transferring device for transferring a visible image to the transfer sheet and a charging device for charging the photosensitive drum. The cleaning device is omitted from the image forming apparatus and a developing device for developing an electrostatic latent image can also serve as the cleaning device. Alternatively, the cleaning device is disposed between the charging device and the developing device.

10 Claims, 9 Drawing Sheets

REVERSE DEVELOPING IMAGE FORMING APPARATUS WITH DISTURBING MEANS

This is a division of application Ser. No. 507312 filed Nov. 19, 1986, which, in turn, is a continuation of Serial No. 571,800, filed Jan. 8, 1984, U.S. Pat. No. 4,727,395.

BACKGROUND OF THE INVENTION

The present invention relates to an image forming apparatus for forming a latent image on an image carrier via an exposure, developing the latent image by a developing agent into a visible image, and transferring the developed visible image to a transfer sheet.

In copying machines and laser printers which utilize the electrophotographic recording process, a photosensitive drum, which serves as an image carrier, is repeatedly used. For this reason, a photosensitive drum cleaning means for removing residual developing agent particles left on the photosensitive drum must be disposed between a transferring means for transferring a visible image to a transfer sheet and a latent image forming means for forming a latent image on the photosensitive drum by charging.

One conventional laser printer has the construction shown in FIG. 1. A photosensitive drum 2 disposed at the center in a housing 1 is uniformly charged with a positive polarity by a charger 3. A laser beam 5 scanned by a scanner 4 is focused by an F$\theta$ lens 6 on the photosensitive drum 2. The laser beam 5, which is intermittently emitted upon the ON/OFF operation of the power supply, exposes the surface of the photosensitive drum 2 to selectively discharge the photosensitive drum 2, thereby forming a latent image thereon. The latent image on the photosensitive drum 2 is developed with a developing agent, by a developing unit 7 having a developing roller to which a proper bias voltage is applied. The developed visible image is transferred by a transferring charger 8 to a transfer sheet P. The transferred image is then fixed by a fixer 9. The residual developing agent particles which are not transferred to the sheet P but are left on the photosensitive drum 2 are removed by a cleaning blade 11 of a cleaning unit 10. The cleaned photosensitive drum 2 is discharged by a discharging lamp 12. The photosensitive drum 2 is then uniformly re-charged with the positive polarity by the charger 3. The above operation is then repeated.

A plurality of transfer sheets P are set in a supply cassette 13 and are picked up, one by one, by a pick-up roller 14. The leading end of each picked-up transfer sheet P is adjusted by an aligning roller 15, to correct the ramp of the sheet, and the sheet is fed into a transfer section defined between the transferring charger 8 and the photosensitive drum 2 at an image forming timing of the photosensitive drum 2. Upon operation of the transferring charger 8, the transfer sheet P having the visible image thereon is separated from the photosensitive drum 2 and is supplied to the fixer 9. Thereafter, the fixed transfer sheet P having the visible image thereon is ejected into a tray 18 through an exhaust roller 17. The exhaust tray 18 is disposed at that side of the housing 1 which opposes the side at which the supply cassette 13 is mounted.

FIGS. 2, 3 and 4 respectively show conventional processes wherein the photosensitive drum is repeatedly used. A cycle of charging (1), exposure (2), development (3), transfer (4), cleaning (5), discharging (6), and charging (1), as shown in FIG. 2, indicates a normal development process (wherein a developing agent having a polarity opposite to that of the charged carriers is attracted to a nonexposed portion of the photosensitive drum) wherein the photosensitive drum is repeatedly used. On the other hand, a cycle of charging (1), exposure (2), development (3), transfer (4), cleaning (5), discharging (6) and charging (1), as shown in FIG. 3, indicates a reverse developing process (wherein a bias voltage is applied to the developing roller, and one-component developing agent particles are charged and are attracted to an exposed portion of the photosensitive drum) wherein the photosensitive drum is repeatedly used.

As is apparent from the conventional processes described above, to repeatedly use the photosensitive drum, the residual developing agent particles must be removed from the photosensitive drum after each transfer operation is completed. In the normal development process shown in FIG. 2, one may assume that cleaning (5) is omitted and that the photosensitive drum is immediately discharged after transfer (i.e., that a cycle is performed in an order of charging (1'), exposure (2'), development (3), transfer (4), discharging (6') and charging (1')). In this cycle, excluding the cleaning operation, the residual developing agent on the photosensitive drum is charged during charging (1'), and is exposed by exposure (2'). Therefore, the residual developing agent particles will not be removed from the photosensitive drum during development (3), since the residual potential of the photosensitive drum becomes substantially the same as the developing bias voltage. The residual developing agent particles are transferred to the transfer sheet P during transfer (4). Therefore, the residual developing agent particles cause background fog or scumming, resulting in a poor image.

Even in the reverse development process using one-component developing agent particles, one may assume that cleaning (5) is omitted and that transfer is immediately followed by discharging, i.e., that a cycle is performed in an order of charging (1'), exposure (2'), development (3), transfer (4), discharging (6') and charging (1'). In the process excluding cleaning (5), the charged particles left on the charged portion of the latent image after exposure (2') cannot be removed, since the developing bias voltage V becomes substantially the same as the surface potential V0 of the charged portion of the photosensitive drum during development (3). In the same manner as in the cycle shown in FIG. 2, the residual developing agent particles are transferred to a transfer sheet during transfer (4), thus resulting in a poor image. Therefore, cleaning of the photosensitive drum must inevitably be performed between transfer (4) and charging (1), in the processes shown in FIGS. 2 and 3, wherein the photosensitive drum is repeatedly used.

However, to clean the photosensitive drum, the requirement for a cleaning unit increases the internal space required for the housing, so that the recording apparatus (as a whole) would be large in size. Second, a mechanical stress acts on the photosensitive drum since a cleaning member such as a cleaning blade must be brought into sliding contact with the photosensitive drum. The photosensitive drum is susceptible to damage and to the formation of a film of residual charged particles, thus degrading the image quality.

To solve the above problem, a conventional process has been proposed, wherein a photosensitive drum is rotated twice for one image forming cycle, in such a way that a developing bias voltage changes during the second revolution of the photosensitive drum, to employ a developing unit as a cleaning unit, which developing unit is used for development during the first revolution of the photosensitive drum. FIG. 4 shows this process. The photosensitive drum is rotated for the first time, becoming operable in an order of charging (1), exposure (2), development (3), transfer (4) and discharging (5). The photosensitive drum is then rotated for the second time, to perform a cleaning operation in an order of discharging (5), cleaning (6) and charging (1). Referring to FIG. 4, the photosensitive drum is uniformly charged with a positive polarity during the charging (1) stage, and has a surface potential V0. The photosensitive drum is then exposed by exposure (2) so that a latent image is formed thereon. By development (3), a developing roller which is so biased as to have a potential which is equal to or slightly higher than the potential of the residual potential of the exposed portion of the photosensitive drum causes the developing agent having a polarity opposite to that of the charged carriers on the latent image to be attracted to the charged portion of the latent image. During transfer (4), the developed visible image on the photosensitive drum is transferred by a transferring charger to a transfer sheet. By discharging (5), the photosensitive drum is electrically discharged by a discharging lamp. Thus, the photosensitive drum is rotated by one revolution. Thereafter, the developing bias voltage V is so set as to fall within a range of $0<V<V0$. Under such conditions, the developing roller serves as a cleaning means, to remove the residual developing agent particles from the photosensitive drum while the photosensitive drum completes the second revolution. In this manner, one recording cycle is completed by two revolutions of the photosensitive drum.

However, in this process for allowing repeated use of the photosensitive drum, the circumferential length of the photosensitive drum must be longer than that of an image recorded by one cycle. One may assume that the circumferential length is shorter than that of the image. When the leading end of the image formed on the photosensitive drum reaches a position where it opposes the developing roller, the trailing end thereof is still subjected to development. As a result, the developing roller cannot serve as the cleaning means, and the residual developing agent particles on the drum portion carrying the leading end of the image are left on the photosensitive drum and cannot be removed therefrom. Therefore, according to this process, the circumferential length of the photosensitive drum, hence, its outer diameter, must be increased. In addition to this disadvantage, since one of every two revolutions is used for cleaning, the utilization efficiency of the photosensitive drum is reduced to 50%. The recording rate is thus decreased, and two bias power supplies are required to change the bias voltage applied to the developing roller.

In the image forming apparatus which employs the reverse development process and uses a two-component developing agent, the cleaning of the photosensitive drum is performed between transfer and charging, in the same manner as in FIG. 1.

In conventional copying machines and laser printers which use the electrophotographic recording process, removal of the residual developing agent particles left on the photosensitive drum as an image carrier is performed between transfer and latent image formation, by means of charging and exposure, with respect to the photosensitive drum. Therefore, the developing means for applying the developing agent to the photosensitive drum is so located as to be spaced apart from the cleaning means, with the result that the inside of the housing tends to become contaminated, necessitating countermeasures for preventing the respective components from becoming contaminated.

SUMMARY OF THE INVENTION

The present invention has been contrived in view of the above, and has for its primary object to provide a compact image forming apparatus wherein damage to and film formation upon an image carrier, such as a photosensitive drum, are prevented.

The present invention has for its secondary object to provide an image forming apparatus wherein a possible contamination area caused by the scattering of a developing agent is minimized; countermeasures for preventing components from being contaminated with the scattered developing agent particles can be easily provided; and proper cleaning can be performed, even after a transfer sheet becomes jammed.

According to a first aspect of the present invention, there is provided a structure wherein a cleaning means which allows for the repeated use of the image carrier is removed from a space between a transferring means for transferring a visible image to the transfer sheet and a latent image forming means for forming a latent image by charging and exposing the image carrier, so that a developing means can also serve as the cleaning means.

According to a second aspect of the present invention, a structure is provided wherein a cleaning means which allows for the repeated use of the image carrier is removed from a space between a transferring means for transferring a visible image to the transfer sheet and a latent image forming means for forming a latent image by charging and exposing the image carrier, and is disposed between the latent image forming means and a developing means.

DETAILED DESCRIPTION OF THE PREFERRED EMBODIMENTS

An image forming apparatus according to an embodiment of the present invention may now be described in greater detail, with reference to FIGS. 5 to 11.

Figure 5:
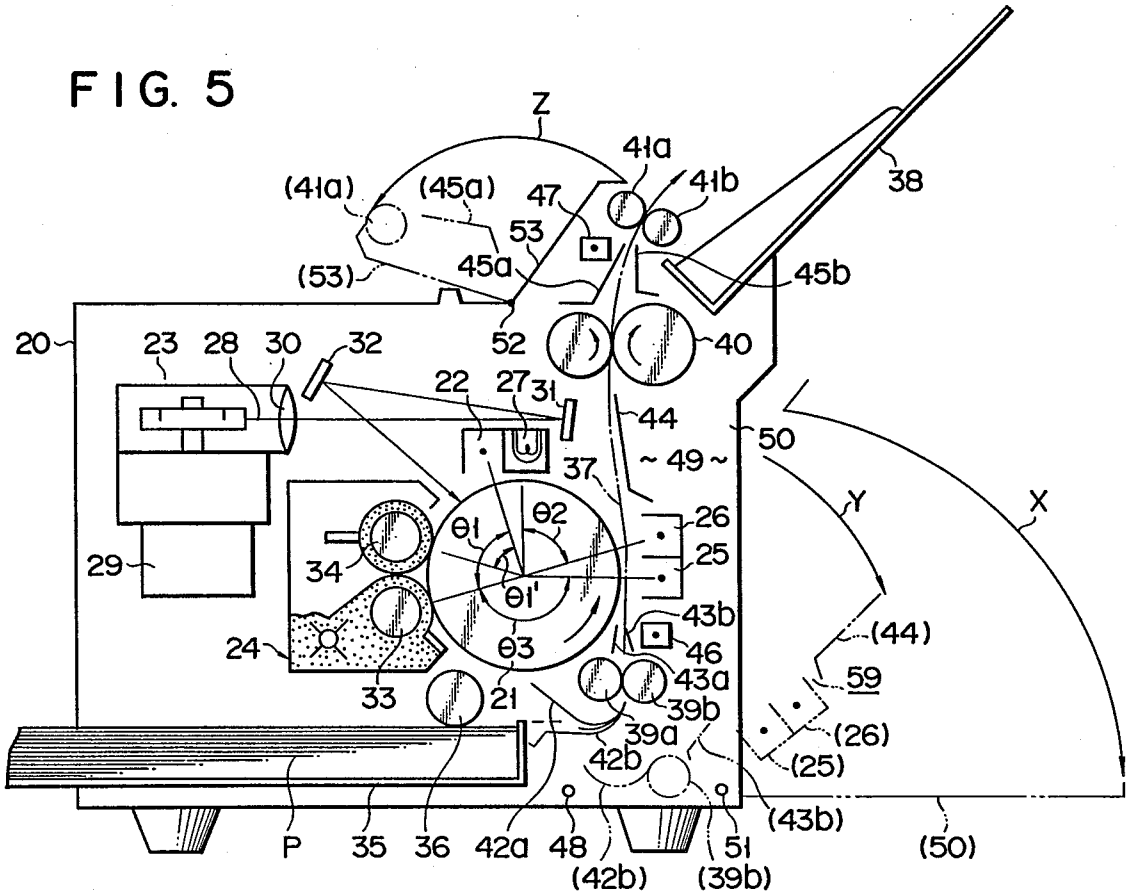
FIG. 5 is a sectional view schematically showing an image forming apparatus according to a first embodiment of the present invention.

FIG. 5 shows the schematic construction of a laser printer which serves as an image forming apparatus. Reference numeral 20 denotes a laser printer housing. A photosensitive drum 21 having a selenium (Se) layer as a photosensitive layer and serving as an image carrier is so disposed in the housing 20 as to be rotatable counterclockwise. A charger 22, a beam irradiation portion of a laser exposure unit 23 and a developing unit 24 are respectively disposed at the upper side, at the upper left side and to the left of the photosensitive drum 21 along its rotational direction. A transferring charger 25, a separation or peeling charger 26 adjacent to the transferring charger 25, and a discharging lamp 27 adjacent to the charger 22 are sequentially disposed to the right of the photosensitive drum 21 in its rotational direction.

The laser exposure unit 23 scans a laser beam 28 which is generated from a laser oscillator (not shown) with a laser scan motor 29, and causes the laser beam spot to irradiate the photosensitive drum 21, through an F$\theta$ lens 30, a first mirror 31 and a second mirror 32. The developing unit 24 has first and second developing rollers 33, 34 which generate a magnetic field and form a latent image in accordance with a two-component toner system.

A cassette 35 is attached at the lower left side of the housing 20. Transfer sheets P set within the cassette 35 are picked up, one by one, by a pick-up roller 36. Each picked-up transfer sheet P is exhausted into an exhaust tray 38 disposed at the upper portion of the housing 20 through an L-shaped convey path 37 (indicated by the alternate and short dashed line) along the rotational direction of the photosensitive drum 21, such that the sheet P passes through a transfer section defined between the photosensitive drum 21 and the transferring charger 25.

A pair of aligning rollers 39*a*, 39*b* are disposed along a portion of the convey path 37 which is located upstream of the transfer section. A fixing unit 40 and a pair of exhaust rollers 41*a*, 41*b* are disposed at portions of the convey path 37 which are located downstream of the transfer section. A pair of pre-aligning roller guides 42*a*, 42*b* and a pair of pretransfer guides 43*a*, 43*b* are respectively disposed along portions of the convey path 37 which are located before and after the pair of aligning rollers 39*a*, 39*b*. A prefixing unit guide 44 and a pair of pre-exhaust roller guides 45*a*, 45*b* are respectively disposed along portions of the convey path 37 which are located before and after the fixing unit 40. A pretransfer sensor 46 is so disposed as to cross the convey path 37 at a position corresponding to the pretransfer guides 43*a*, 43*b*. A pre-exhaust roller sensor 47 is so disposed as to cross the convey path 37 at a position corresponding to the pre-exhaust roller guides 45*a*, 45*b*.

The pre-aligning roller guide 42*b*, the aligning roller 39*b*, the pretransfer guide 43*b*, the transferring charger 25, the peeling charger 26, and the prefixing unit guide 44 are mounted on a frame (not shown) which can pivot about a shaft 48. This frame can be pivoted toward a maintenance opening 49 formed at the right side surface of the housing 20, as indicated by the alternate long and two short dashed line.

Reference numeral 50 denotes an access door which is mounted on the right side surface of the housing 20, and which can freely open/close the maintenance opening 49. The access door 50 can pivot about a shaft 51, toward the outside.

The pre-exhaust roller guide 45*a* and the exhaust roller 41*a* are mounted on a cover 53 which is mounted on the housing 20 in such a way as to be pivotal about a shaft 52. The cover 53 can pivot in the manner indicated by the alternate long and two short dashed lines.

It should be noted here that the peripheral speed of the photosensitive drum 21 is set at 133.3 mm/sec, its diameter is 78 mm, and the laser power incident on the photosensitive drum 21 is 3.5 mW, for example. In this laser printer, the entire circumferential length of the photosensitive drum 21 is thus shorter than the length of the sheet P which is measured in the rotational direction of the photosensitive drum 21.

The operation of the laser printer having the construction described may be described as follows.

When a printing instruction is transmitted to the laser printer, first, a drive motor (not shown) and, then, the individual parts of the laser printer are started. At the same time, a voltage is applied to the charger 22, and the discharging lamp 27 is turned on. The photosensitive drum 21 uniformly charged with the positive polarity by the charger 22 is scanned with the laser beam 28 by the scanner 29. A negative latent image is formed on the photosensitive drum 21.

One may assume that the rotatational speed of the photosensitive drum 21 is given as $\omega$ radians/sec, and that the phase difference between the center of the charger 22 and the center of the first developing roller 33 is given as $\theta 1$. Thus, that portion of the photosensitive drum 21 which is charged by the charger 22 reaches the first developing roller 33 in $\theta 1/\omega$ seconds. In this case, a developing bias voltage V is applied to the first and second developing rollers 33, 34. The developing bias voltage V is set at a level which is about half (V0/2) of the surface potential V0 of the unexposed portion of the photosensitive drum 21 ($0<V<V0$). Therefore, the portion exposed by the laser beam 28 attracts developing agent particles which are charged with the same polarity (i.e., positive polarity) as the unexposed portion of the photosensitive drum 21. Such particles will not be attracted to the unexposed portion. The negative latent image is developed by the first and second developing rollers 33, 34.

Meanwhile, in synchronism with the movement of the latent image, the transfer sheet P is picked up by the pick-up roller 36 and is fed toward the aligning rollers 39*a*, 39*b*. The aligning rollers 39*a*, 39*b* are rotated at a given timing, and the transfer sheet P stops at a position where the leading end of the transfer sheet P is aligned with that of the latent image. When the leading end of the transfer sheet P reaches the image transfer position, i.e., when a time interval of $\theta 3/\omega$ seconds (corresponding to the phase difference between the first developing roller 33 and the transferring charger 25) has elapsed, the transferring charger 25 and the peeling charger 26 are simultaneously energized. A negative charge is applied to the lower surface of the transfer sheet P, so that the potential of the transfer sheet P is lowered. Therefore, the visible image on the photosensitive drum 21 is transferred to the transfer sheet P. Thereafter, the transfer sheet P is discharged by the peeling charger 26 comprising an AC charger biased at a positive voltage of 1 KV, and is separated from the photosensitive drum 21. The transfer sheet P is fed upward along the prefixing unit guide 44 and is clamped between heat rollers of the fixing unit 40. The visible image on the transfer sheet P is melted and is fixed on the sheet P. Thereafter, the transfer sheet P is brought into rolling contact with and between the exhaust rollers 41*a*, 41*b*, and is ejected from the laser printer. The ejected sheets are stacked in the exhaust tray 38.

On the other hand, the developing agent particles which are not associated with development of the visible image transferred to the sheet P are left on the photosensitive drum 21. The behavior of the particles left on the photosensitive drum 21 may be described with reference to the repeated operation of the photosensitive drum 21.

Figure 6:
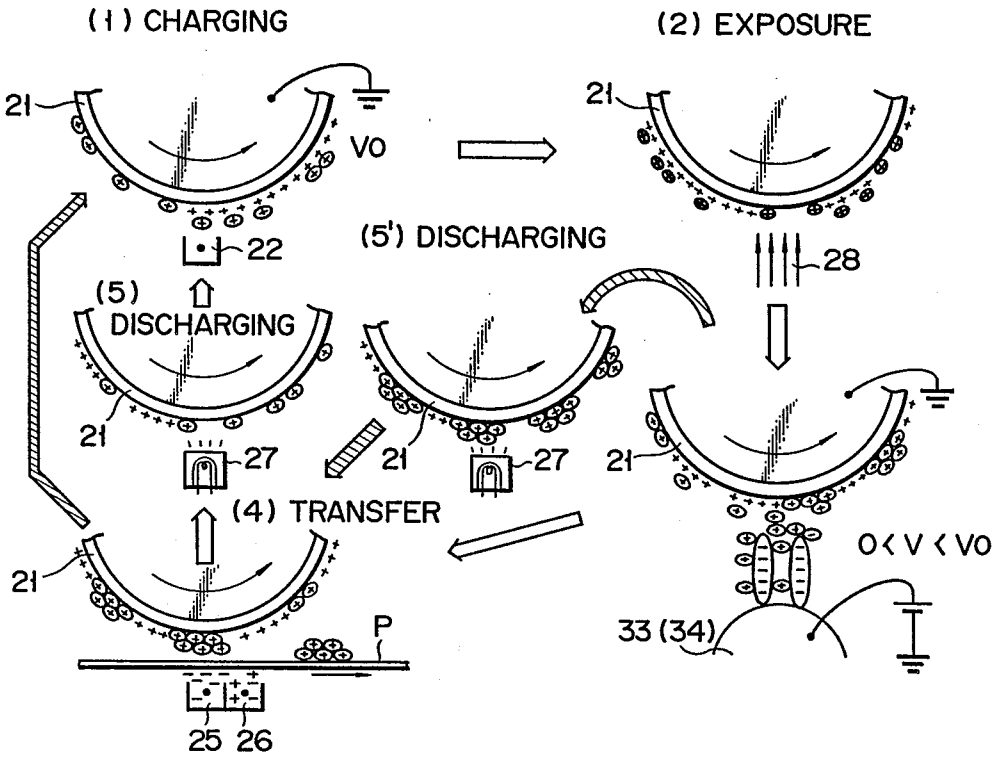
FIG. 6 is a representation showing an image forming process according to the apparatus shown in FIG. 5.

A transfer step (4) is reached, in a cycle with an order of charging (1), exposure (2), development (3) and transfer (4). The repeated operation of the photosensitive drum 21 may now be described, wherein another sheet is subjected to recording, starting from the transfer step (4). Most (about 80% transfer efficiency) of the developing agent particles of the visible image reverse-developed on the photosensitive drum 21 during transfer (4) are transferred to the transfer sheet P. However, as shown in FIG. 6, some of the developing agent particles are left on the photosensitive drum 21, while discharging (5) is begun. During this step, the photosensitive drum 21 is almost completely discharged. Thereafter, during charging (1), the photosensitive drum 21 and the residual developing agent particles left on the photosensitive drum 21 are uniformly charged.

Figure 7:
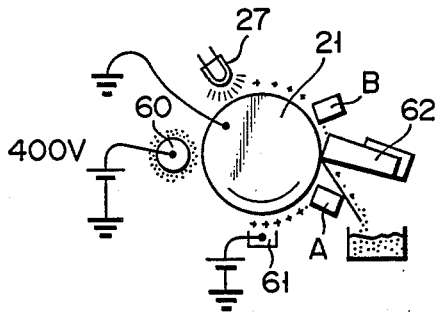
FIG. 7 is a schematic view showing a process test device.
Figure 8:
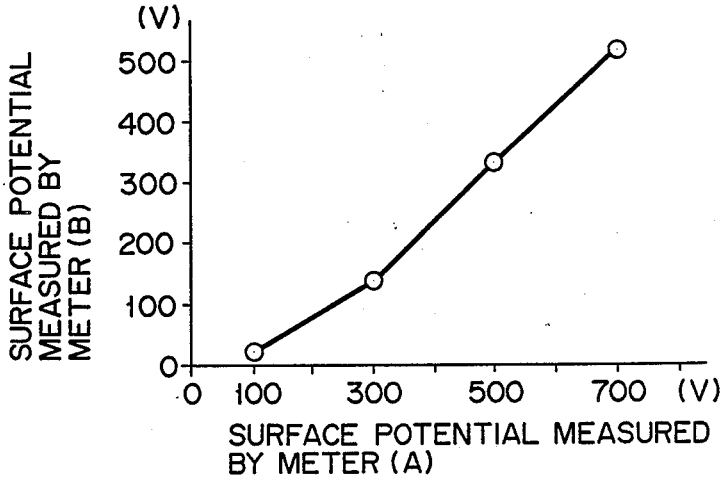
FIG. 8 is a graph showing charge injection characteristics wherein charged carriers are applied to the surface of the photosensitive drum, through a toner layer.

The following fact was proved in accordance with the experimental results shown in FIGS. 7 and 8. Assume that the developing agent is uniformly applied to the photosensitive drum 21 at a C.D. (copy density) of 1.3. When the photosensitive drum 21 was charged through the residual developing agent particles, it was found that most of the carriers pass through the residual developing agent layer and the surface of the photosensitive drum 21 could be uniformly charged through the residual developing agent layer. FIG. 7 schematically shows a test device. In this test device, a two-component developing agent is uniformly applied, by a developing roller 60, to a copy density of 1.3, when a positive bias voltage of +400 V is applied to the developing roller 60. Thereafter, the photosensitive drum 21 is uniformly charged with a positive polarity, by a charger 61, through the residual developing agent layer.

The surface potential of the photosensitive drum 21 is measured by a surface potentiometer A. The measured results are plotted along the axis of abscissa of the graph shown in FIG. 8. Furthermore, the developing agent layer on the photosensitive drum 21 is completely removed by a cleaning blade 62, and a surface potential of the cleaned photosensitive drum 21 is measured again by a surface potentiometer B. The measured results are plotted along the axis of ordinate of the graph shown in FIG. 8. When the potential measured by the potentiometer A is +700 V, the potential measured by the potentiometer B is about +500 V. Therefore, in this state, a charge absorbed by the residual developing agent particles is about +200 V. However, in practice, it is found that the photosensitive drum 21 is charged with about −100 V due to friction charge between the selenium layer of the photosensitive drum 21 and a urethane rubber member of the cleaning blade 62. Therefore, the charge absorbed by the residual developing agent particles left on the photosensitive drum 21 is about 100 V. In this manner, even if the photosensitive drum 21 is charged through the residual developing agent layer at a copy density of 1.3, the charged carriers mainly reach the surface of the photosensitive drum 21.

The density of the residual developing agent particles is set at about 20%, since the transfer efficiency is about 80% according to the present invention. Therefore, even if the photosensitive drum 21 is charged through the residual developing agent layer, the photosensitive drum 21 may be uniformly charged, and the charged carriers can be attracted to the surface of the photosensitive drum 21 beneath the residual developing agent layer.

Figure 9:
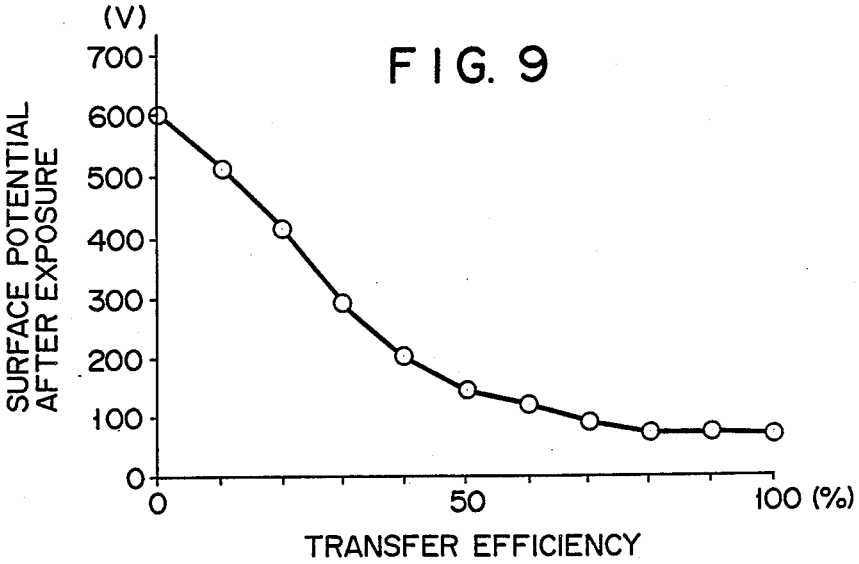
FIG. 9 is a graph showing drum exposure characteristics through a residual toner.

The description will now return to the repeated use of the photosensitive drum 21, which is shown in FIG. 6. In exposure (2) next to charging (1), the charged photosensitive drum 21 is exposed. In this case, residual developing agent particles are present on the exposed portion of the photosensitive drum 21. Under these circumstances, the following experiment was conducted. The uniformly charged photosensitive drum 21 was uniformly developed over the entire surface (with the copy density D of the developing agent on the photosensitive drum 21 being 1.3), and was charged in such a way that the surface potential thereof was set at +750 V. In the photosensitive drum 21, first, the strength of the transferring charger 25 and, then, the transfer efficiency, were changed, to measure the surface potential of the photosensitve drum 21 when laser exposure was performed. The results are illustrated in FIG. 9. The experimental conditions were set in such a way that the surface potential of the photosensitive drum after charging and before exposure was 750 V, the developing agent density D of the photosensitive drum was 1.3, the developing bias voltage was 400 V, the drum sensitivity (half exposure) was 1.5 $\mu J/cm^2$, and the laser power on the surface of the photosensitive drum was 5.6 $\mu J/cm^2$. As is apparent from FIG. 9, the surface potential of the photosensitive drum 21 is decreased to about 80 V when the transfer coefficient is about 70% or more. The potential of 80 is substantially the same as that of the residual potential of the exposed portion of the photosensitive drum 21 in the normal exposure mode. When the transfer efficiency becomes 70% or more, the residual developing agent layer formed on the photosensitive drum 21 does not adversely affect exposure. Therefore, during exposure (2), even if a residual developing agent is present in the exposure portion, it is found that the residual developing agent does not substantially influence the formation of another latent image.

The developing step (3) is then performed. The following fact was confirmed in accordance with the experiments, with reference to FIGS. 7, 8 and 9 and the practical recording operation. In the reverse development process using the two-component developing agent, as described above in the first embodiment, the residual developing agent particles which are present on the charged portion of the latent image are removed from the photosensitive drum 21 during development (3), and the developing agent particles charged with the same polarity as that of the unexposed portion are attracted to the exposed portion of the photosensitive drum 21. In other words, development of the latent image and cleaning of the photosensitive drum 21 may be simultaneously performed, for the following reason.

The photosensitive drum 21 is uniformly charged with a voltage of +V0 during charging (1). Thereafter, even if the residual developing agent layer is left on the exposed portion during exposure (2), the surface potential of the exposed portion of the photosensitive drum 21 is uniformly lowered to the residual potential. On the other hand, it is apparent that the most of the charged carriers are uniformly attracted to the surface portion of the photosensitive drum 21 which is located beneath the residual developing agent layer on the nonexposed portion, as shown in FIGS. 7 and 8. The potential of the nonexposed portion is thus +V0. The developing roller 33 (34) which is so biased as to satisfy the equation $V=V0/2$ $(0<V<V0)$ is brought into sliding contact with the surface portion of the photosensitive drum 21 which carries the latent image. Therefore, an electrical field is generated in the unexposed portion of the photosensitive drum 21, in such a way that its flux is directed from the photosensitive drum 21 to the developing roller 33 (34). The residual developing agent on the unexposed portion is located within the above electrical field, and is charged with the same polarity as the charging polarity, so that the residual developing agent is removed from the surface of the photosensitive drum 21, and is moved toward the developing roller 33(34). Thus, the photosensitive drum 21 is cleaned.

Since the developing unit 24 has first and second developing rollers 33, 34 in the embodiment described above, the photosensitive drum 21 is completely cleaned. When the first developing roller 33 is used to clean the photosensitive drum 21, the second developing roller 34 serves as a subcleaning means.

On the other hand, an electrical field is generated from the exposed portion of the photosensitive drum 21, in such a way that a flux thereof is directed from the developing roller 33 (34) to the photosensitive drum 21. According to the system using the two-component developing agent of this embodiment, the developing roller 33 (34) is brought into sliding contact with the photosensitive drum 21, due to the magnetic force of the developing roller 33 (34), so that the developing agent may be held in sliding contact with the photosensitive drum 21 and may be charged with a positive polarity, and so that the positive developing agent particles may be attracted to the negative mirror (latent) image formed on the photosensitive drum 21. In other words, the positively charged developing agent particles placed in the electrical field are directed, from the developing roller 33 (34), to the photosensitive drum 21, so that the electrically positive particles are moved toward the exposed portion (i.e., the latent image or electrically negative portion) of the photosensitive drum 21. Therefore, the latent image is developed by the developing agent. During repeated operation of the photosensitive drum 21 of the laser printer of the present invention, development of the image and cleaning of the photosensitive drum 21 can be simultaneously performed. The residual developing agent will not be transferred to the transfer sheet P, thus eliminating background fog and scunning.

Furthermore, the residual developing agent is electrically removed from the photosensitive drum 21 according to this embodiment. For this reason, unlike in the case of drum cleaning using a cleaning blade or fur brush, the photosensitive drum 21 will neither be mechanically damaged nor subjected to film formation. In addition to these advantages, separate cleaning means can be eliminated from the laser printer (electrophotographic recording apparatus), thereby providing a compact laser printer.

Figure 10:
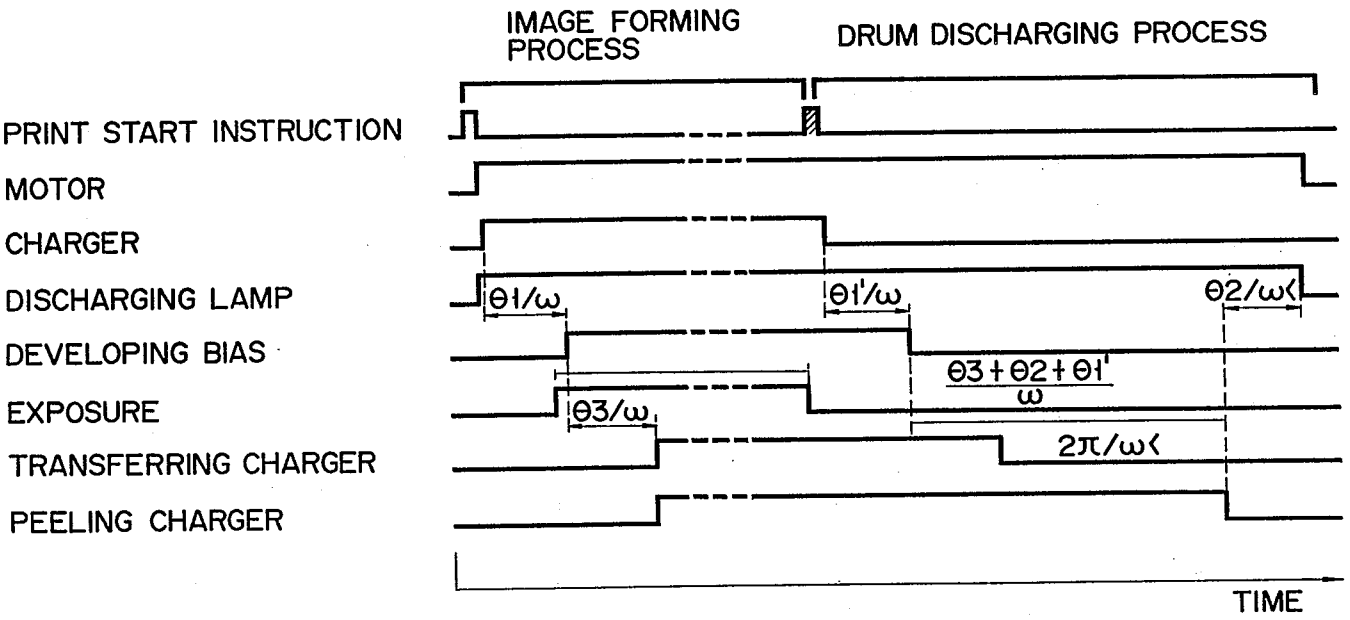
FIG. 10 is a timing chart showing the timings of an image forming process and a drum discharging process, after printing has been completed.

The stop operation of the component parts of the laser printer, when one-sheet printing is completed, may be described as follows. FIG. 10 shows timings between the one-sheet printing process and the ON/OFF operation of the individual components used in the drum discharging process after the last printing operation is completed. When a one-sheet printing process is completed, i.e., when the laser exposure for one sheet is completed, the charger 22 is de-energized within a short period of time thereafter. When a time interval of $01'/\omega$ seconds has elapsed after the charger 22 is turned off (i.e., when the trailing end of the charged portion reaches the second developing roller 34), the developing bias voltage is stopped, where 01′ (FIG. 5) is the phase difference between the charger 22 and the second developing roller 34. Therefore, even if the photosensitive drum 21 continues to rotate, further development of the image on the photosensitive drum 21 will not be performed. When a time interval of $(\theta 3+\theta 1-01')/\omega$ seconds has elapsed, the transferring charger 25 is de-energized to complete transfer of the developed image corresponding to a one-sheet content. Here, it should be noted that $\theta 3$ is the phase difference between the first developing roller 33 and the transferring charger 25.

The photosensitive drum 21 continue to rotate and holds the peeling charger 26 in the ON state for at least $2\pi/\omega$ seconds after the developing bias voltage is stopped. When a time interval of $\theta 2/\omega$ seconds has elapsed, after the peeling charger 26 has been turned off, the motor and the discharging lamp 27 are turned off. During this final discharging process, the photosensitive drum 21 can be completely discharged, since it has the positive discharging polarity, so that the degradation of image quality caused by residual charge can be completely eliminated.

When the next printing instruction is transmitted, the motor, the charger 22 and the discharging lamp 27 are simultaneously turned on. The developing bias voltage is not applied to the first developing roller 33 until the charged portion of the photosensitive drum 21 reaches the first developing roller 33. Therefore, since the developing bias voltage is not applied to the noncharged portion, a portion other than the image transfer area will not be developed. According to this embodiment, image formation is not performed in a non-image transfer area portion at the beginning and end of printing. For this reason, an excessive developing agent layer will not be formed on the photosensitive drum 21 after transfer operation is completed, thereby preventing the printed image from being degraded. As a result, an image of good quality can normally be obtained.

Figure 11:
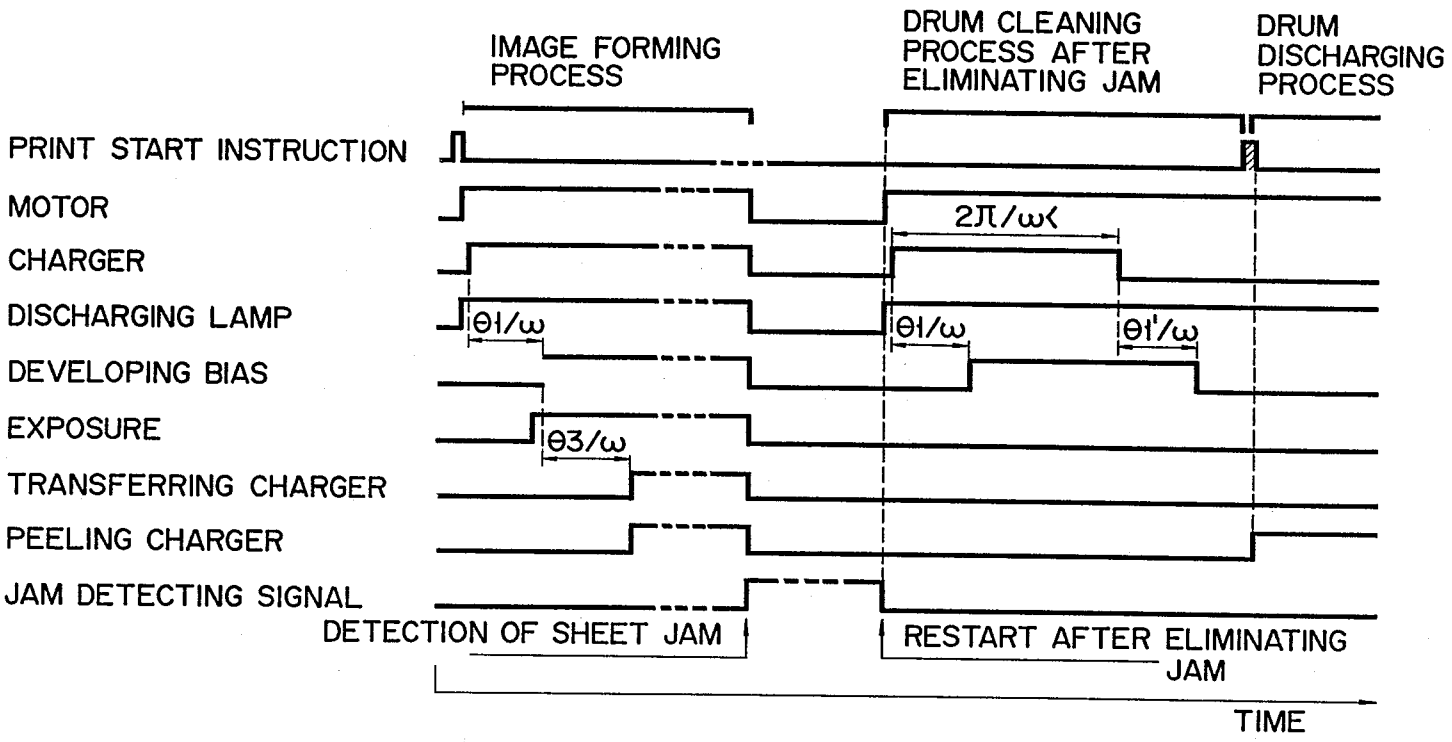
FIG. 11 is a timing chart showing the timings of a drum cleaning process at the time of transfer sheet jamming and a drum cleaning process after the jam has been released.

The mode of operation which applies when the transfer sheet P is jammed in the laser printer may be described as follows. The time difference between the generation of a sensor signal 46 for detecting that the transfer sheet P is passing between the pre-transfer guides 43*a*, 43*b*, and the generation of a sensor signal 47 for detecting that the transfer sheet P is passing between the pre-exhaust roller guides 45*a*, 45*b*, is compared to a preset timer time. When the time difference is longer than the preset time, the transfer sheet P is detected to be jammed, and a jam signal is generated. When the jam signal is generated, the motor and the components shown in FIG. 11 are all stopped, and a jam indicator on the control panel is turned on. The operator can remove the jammed transfer sheet P from the laser printer in the following manner.

As shown in FIG. 5, the operator opens the maintenance opening portion 49, by pivoting the access door 50 about the shaft 51 (mounted at the obliquely lower portion of the housing 20), in the direction indicated by the arrow X, from the right side surface of the housing 20. The operator thus moves an assembly unit 59, which is mounted on the frame (not shown) and comprises the pre-aligning roller guide 42*b*, the aligning roller 39*b*, the pre-transfer guide 43*b*, the transferring charger 25, the peeling charger 26 and the prefixing unit guide 44. The assembly unit 59 is pivoted in the direction shown by arrow Y, to remove the jammed sheet P from the housing 20. Thereafter, the assembly unit 59, and, then, the access door 50, are returned to the housing 20. The operator then enters a reset signal. The jam signal is cancelled by the reset signal.

According to the embodiment described above, the L-shaped convey path 37 of the transfer sheet P is so formed as to surround the lower right portion of the photosensitive drum 21, and the access door 50, which is located on the right side surface of the housing 20, may be pivoted about the shaft 51 located on the oblique lower portion of the housing 20. The assembly unit 59 comprises an integral assembly composed of the prefixing unit guide 44, the transferring charger 25, the peeling charger 26, the pretransfer guide 43*b*, the aligning roller 39*b* and the pre-aligning roller guide 42*b*, and can be pivoted about the shaft 48 located substantially below the photosensitive drum 21, so that the convey path 37 may be widely opened, thereby simplifying the release operation when jamming occurs.

The shape of the convey path 37 may be as described, since the cleaning of the photosensitive drum 21 and the development of the image thereon may be simultaneously performed when the photosensitive drum 21 is repeatedly used.

In the laser printer wherein the jammed transfer sheet P is removed and the jam signal is cancelled, the motor, the charger 22 and the discharging lamp 27 are turned on, and the developing bias voltage is reapplied, once a time interval of $\theta 1/\omega$ has elapsed. The photosensitive drum 21 is rotated for such a period of time as to hold the charger 22 in the ON state for a time interval of at least $2\pi/\omega$ seconds. The residual developing agent left on the photosensitive drum 21 when jamming occurs is removed therefrom by the first and second developing rollers 33, 34, so that the photosensitive drum 21 is cleaned. The developing bias voltage is stopped within a time interval of $01'/\omega$ seconds after the charger 22 has been turned off. When the succeeding printing instruction is not transmitted, at this time, the motor's rotation is stopped, after the photosensitive drum 21 is completely discharged. When the next printing instruction is transmitted, the one-sheet printing process continues, as shown in FIG. 10.

Even if the transfer sheet P is jammed, the residual developing agent layer on the photosensitive drum 21 is completely removed by the first and second developing rollers 33, 34. The photosensitive drum 21 is ready for the next printing operation, thus completely eliminating drawbacks such as background fog or scumming.

Figure 1:
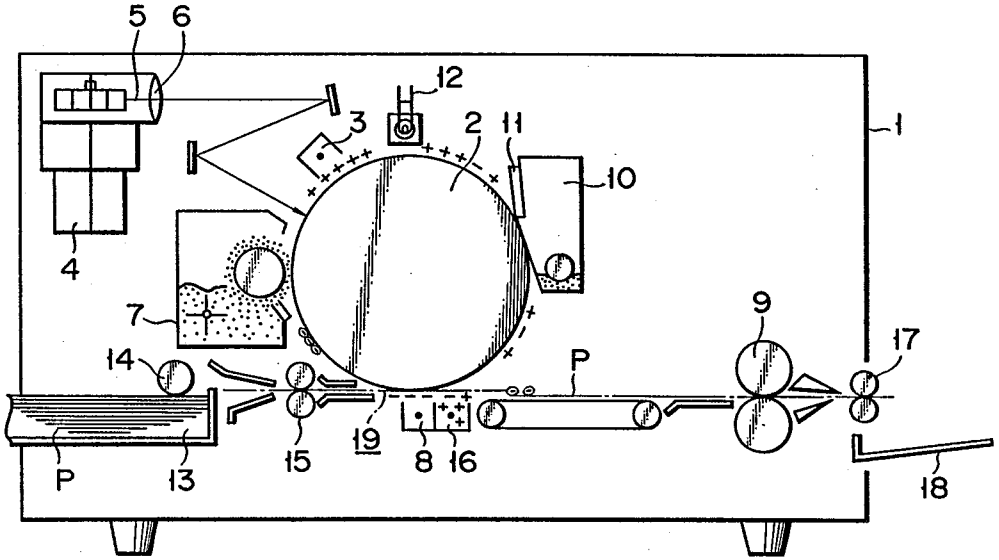
FIG. 1 (PRIOR ART)
FIG. 1 is a sectional view schematically showing a conventional image forming apparatus.
Figure 2:
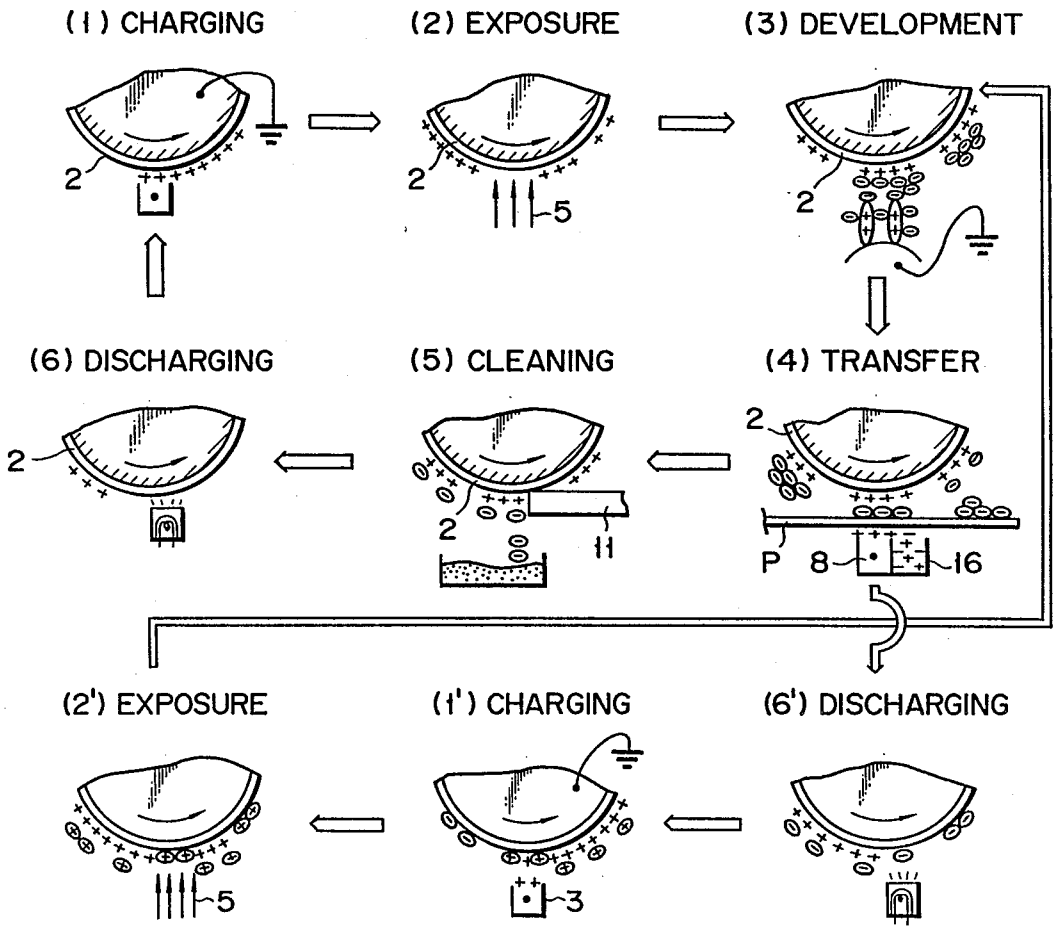
FIG. 2 (PRIOR ART)
FIGS. 2 to 4 are representations showing various conventional image forming processes.
Figure 3:
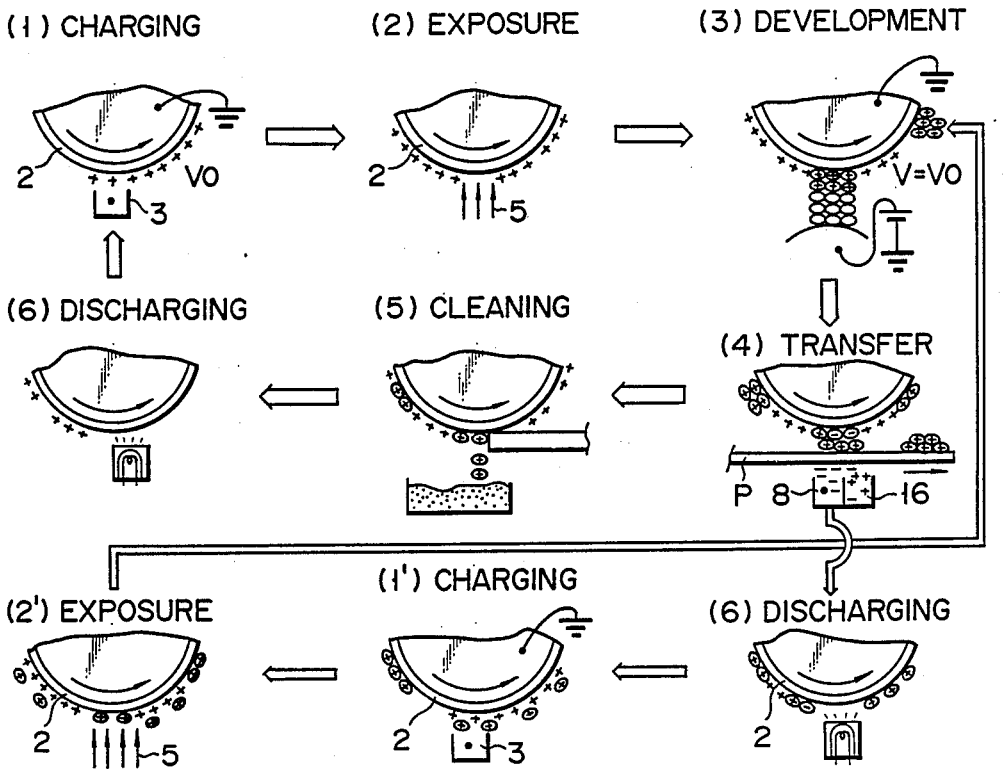
FIG. 3 (PRIOR ART)
Figure 4:
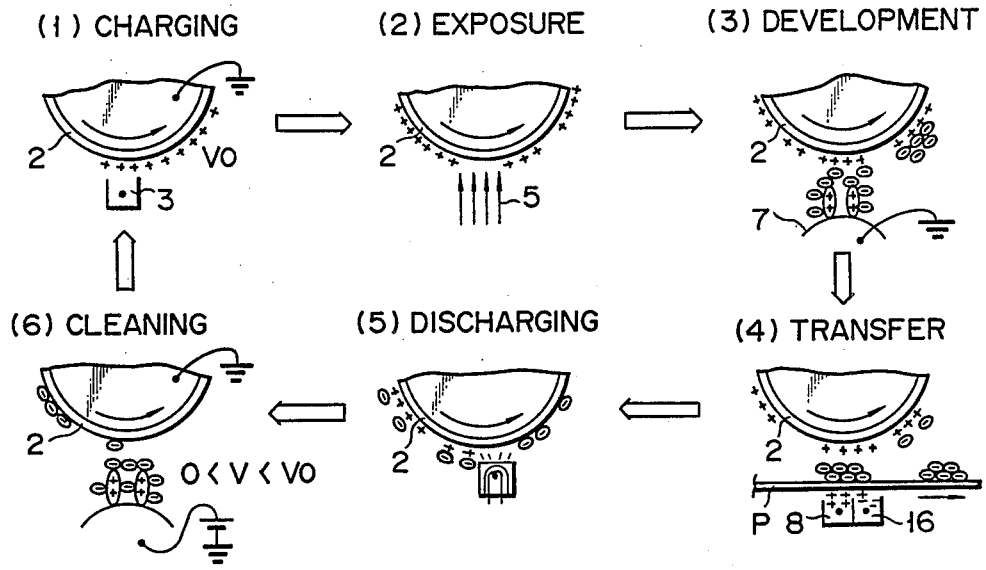
FIG. 4 (PRIOR ART)

The following problem is presented by the conventional image forming apparatus. First, since the cleaning unit is disposed between the transferring means and the charging means, a substantial space must be assured around the photosensitive drum. The space for the the convey path of the transfer sheet is thus limited. For example, in the conventional apparatus shown in FIG. 1, the convey path 19 for the transfer sheet P comprises a horizontal straight path. When the transfer sheet P is jammed, the upper and lower components of the apparatus must be greatly separated with respect to the convey path 19. Conventionally, the ideal position of the cleaning unit 10 is the position shown in FIG. 1. For this reason, the convey path 19 must comprise a straight path. Secondly, since the insertion direction of the transfer sheet P is the same as the exhaust direction thereof, and the paper cassette and exhaust tray are disposed at the lower portion of the housing, at opposing sides thereof, the conventional apparatus of this type is inconvenient, for example, for use as a component apparatus such as a laser printer, which is one of various types of systems equipment. The nature of systems equipment, such as a wordprocessor, inevitably requires that the operator seated at the CRT work station be able to check the printed content, and that all of the systems devices be so installed as to stand against a wall.

According to this embodiment, the cleaning unit is removed from a space between the peeling charger 26 and the discharger 27, to allow for an L-shaped convey path 37, so that the exhaust direction of the transfer sheet P may be directed toward the obliquely upper direction of the housing 20. The transfer sheet P may be stacked in the tray 38 disposed at the upper side portion of the housing 20, as shown in FIG. 5. The attachment position of the cassette 35 mounted on the housing 20, the exhaust position of the transfer sheet P, and the printed sheet checking/reading position are easily accessible to an operator seated at a work station. Thus, the laser printer of the present invention has an optimal construction, as a component of systems equipment.

The exhaust roller 41*a* pivots, in conjunction with the pre-exhaust roller guide 45*a*, in the direction indicated by arrow Z in FIG. 5, to open the terminal end of the convey path. A jammed transfer sheet P can thus be easily removed from the laser printer.

Figure 12:
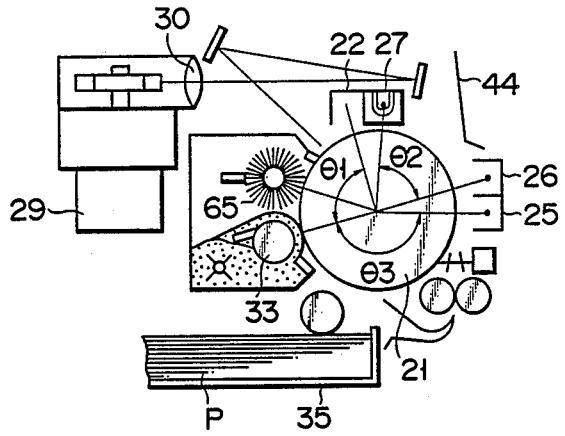
FIG. 12 is a schematic view showing an image forming apparatus according to a second embodiment of the present invention.

The present invention is not limited to the above embodiment. In the above embodiment, the developing unit has first and second developing rollers 33, 34. Development of the latent image and cleaning of the photosensitive drum can be simultaneously performed by the mutual effect of the first and second developing rollers 33, 34. During this operation, removal of the residual developing agent from the unexposed portion of the photosensitive drum 21, and the development of the exposed portion, can be effectively performed. However, when the first developing roller 33 serves as the developing/cleaning means, the second developing roller 34 serves as a subcleaning means, further improving the cleaning capacity of the first developing roller 33. Thus, a fur brush 65, for example, can be used in place of the second developing roller 34, as in the second embodiment shown in FIG. 12. The fur brush 65 is brought into sliding contact with the photosensitive drum 21, to disturb the residual developing agent attached to the surface of the photosensitive drum 21, or to partially scrape the residual developing agent particles away, so that the first developing roller 33 may more effectively remove the residual developing agent.

In the case described with reference to the second embodiment, a fur brush 65 wound around a paper pipe may be used, unlike in the first embodiment, wherein metal parts such as a magnet and sleeve are used. For this reason, the second developing roller 34 may be manufactured at a lower cost. In addition to this advantage, the removed developing agent may be recovered, unlike in the conventional case wherein cleaning is performed between separation and charging. Further, so opposed to the conventional case the developing agent particles will not scatter.

Figure 13:
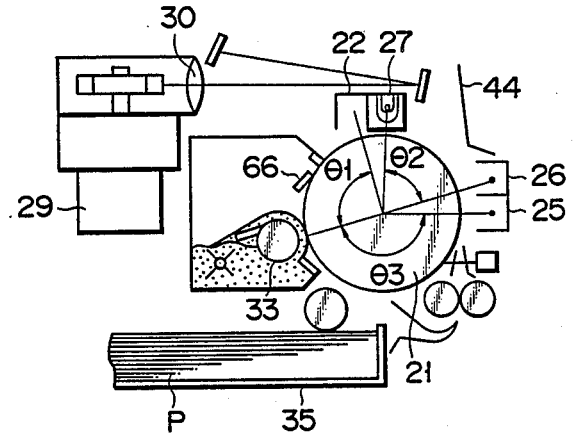
FIG. 13 is a schematic view showing a modification of the second embodiment.

A first modification of the second embodiment (FIG. 12) is illustrated in FIG. 13. Referring to FIG. 13, a cleaning blade 66 may be used in place of the fur brush 65 (FIG. 12), as the subcleaning means. In this case, the same effect may be obtained as in the second embodiment of FIG. 12. In addition to this advantage, the surface of the photosensitive drum 21 may be completely cleaned, as compared to the case wherein the fur brush 65 as a subcleaning means.

Figure 14:
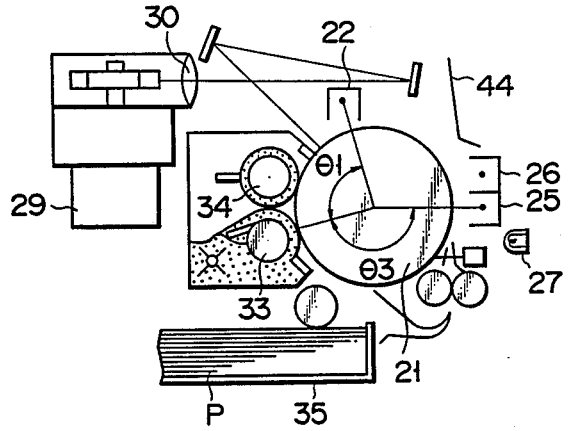
FIG. 14 is a schematic view showing an image forming apparatus according to a third embodiment of the present invention.

A method for discharging the photosensitive drum 21 may be described as follows. In the first embodiment, the discharging lamp 27 is disposed between the transferring charger 25 and the charger 22. The discharging lamp 27 can alternatively be disposed between the developing unit 24 and the transferring charger 25, as shown in the third embodiment of FIG. 14. As is apparent from the method of repeated use of the photosensitive drum, as shown in FIG. 6, the laser printer can perform the cycle of charging (1), exposure (2), development (3), discharging (5'), transfer (4) and charging (1) to eliminate the charging history of the photosensitive drum 21. The portion (i.e., the developed portion) which has the developing agent and which is to be prevented from optical discharging is discharged by exposure. Furthermore, the developing agent is not applied to the unexposed portion. During the discharging operation (5'), the photosensitive drum 21 can be completely discharged. In this manner, since discharging (5') is performed after development and before transfer, the third embodiment has the following advantage, as compared to the first embodiment and conventional examples. In the reverse-development process, the area of the unexposed portion to be printed as a background is considerably greater than that of the developing portion. For this reason, the transfer sheet P appearing immediately after the transfer operation tends not to be properly separated from the photosensitive drum 21, due to the residual charge on the photosensitive drum 21. However, when the discharging lamp 27 is disposed in front of the transferring charger 25, as shown in FIG. 14, the transfer sheet P may be properly separated from the photosensitive drum 21. A degradation of transfer sheet separation from the photosensitive drum 21 may thus be prevented. In addition to this advantage, the discharging lamp 27 need not be disposed in any other position. A compact laser printer may thus be obtained, while its performance is improved.

In the first embodiment, the semiconductor laser beam is used as an exposure light source and is focused on the photosensitive drum 21. The photosensitive drum 21 is then scanned with the laser spot, in its axial direction. However, any other exposure means might also be used. For example, an LED array may be used in place of the laser beam. The light beam from the LED array would be projected onto the photosensitive drum 21, through a SELFOC lens or the like. Furthermore, the present invention might also be applied to a known electronic copying machine.

Thus, various changes and modifications may be made, without departing from the spirit and scope of the present invention.

In an image forming apparatus according to the invention described above, wherein a latent image is formed on an image carrier after charging and exposure are performed, and the latent image is developed, the developed visible image being transferred to a transfer medium, the developing means may also serve as a cleaning means for cleaning the image carrier which is repeatedly used. Moreover, since the developing agent particles are not scattered, the image carrier remains free from damage and film formation. Furthermore, a compact apparatus may be obtained.

What is claimed is:

1. An image forming apparatus comprising a photosensitive member;

charging means for uniformly electrostatically charging the photosensitive member and nay residual toner on said photosensitive member;

exposure means for selectively exposing the electrostatically charged photosensitive member and said residual toner in accordance with data representative of an image, thereby forming an electrostatic latent image corresponding to said image on the photosensitive member;

disturbing means for disturbing the residual toner on said photosensitive member;

reverse developing means having a developing electrode for developing the latent image with toner, said developing means being provided adjacent to the surface of said photosensitive member for causing particles of said toner charged in the same polarity as the electrostatic latent image to adhere to said photosensitive member so as to form a toner image corresponding to the latent image on said photosensitive member and for causing particles of the disturbed residual toner on non-image portions of said photosensitive member which have been charged by said charging means and exposed by said exposure means to be attracted to said developing means to thereby simultaneously develop said latent image and clean said disturbed residual toner from said photosensitive member; and transfer means for transferring said toner image from said photosensitive member to a sheet-like medium.

2. The image forming apparatus according to claim 1, wherein said disturbing means includes a disturbing member which is provided in sliding contact with the photosensitive member for disturbing the residual toner.

3. The image forming apparatus according to claim 2, wherein said disturbing member includes a fur brush.

4. The image forming apparatus according to claim 3, wherein said disturbing member includes a paper pipe around which said fur brush in provided.

5. The image forming apparatus according to claim 2, wherein said disturbing member includes a blade.

6. An image forming apparatus comprising:

storing means for storing a sheet-like medium of a predetermined length;

a photosensitive drum having a circumferential length shorter than said predetermined length;

charging means for uniformly electrostatically charging the photosensitive drum and any residual toner on said photosensitive drum;

exposure means for selectively exposing the electrostatically charged photosensitive drum and said residual toner in accordance with data representative of an image, thereby forming an electrostatic latent image corresponding to said image on the photosensitive drum;

disturbing means for disturbing the residual toner on said photosensitive drum;

reverse developing means having a developing electrode for developing the latent image with toner, said developing means being provided adjacent to the surface of said photosensitive drum for causing particles of said toner charged in the same polarity as the electrostatic latent image to adhere to said photosensitive drum so as to form a toner image corresponding to the latent image on said photosensitive drum and for causing particles of the disturbed residual toner on non-image portions of said photosensitive drum which have been charged by said charging means and exposed by said exposure means to be attracted to said developing means to thereby simultaneously develop said latent image and clean said disturbed residual toner from said photosensitive drum; and transfer means for transferring said toner image from said photosensitive drum to the sheet-like medium.

7. The image forming apparatus according to claim 6, wherein said disturbing means includes a disturbing member which is provided in sliding contact with the photosensitive member for disturbing the residual toner.

8. The image forming apparatus according to claim 7, wherein said disturbing member includes a fur brush.

9. The image forming apparatus according to claim 8, wherein said disturbing member includes a paper pipe around which said fur blush is provided.

10. The image forming appartus according to claim 7, wherein said disturbing member includes a blade.

* * * * *